United States Patent [19]

Gallant

[11] 3,977,609

[45] Aug. 31, 1976

[54] ATOMIZER

[75] Inventor: Donald A. Gallant, Charlotte, N.C.

[73] Assignee: Longwood Machine Works, Incorporated, Woodside, N.Y.

[22] Filed: July 14, 1975

[21] Appl. No.: 595,849

Related U.S. Application Data

[62] Division of Ser. No. 432,746, Jan. 11, 1974, Pat. No. 3,910,496.

[52] U.S. Cl. ..... 239/417.3

[51] Int. Cl.[2] ..... B05B 7/12

[58] Field of Search..... 239/117, 582, 417.3

[56] References Cited

UNITED STATES PATENTS

| | | | |
|---|---|---|---|
| 1,377,687 | 5/1921 | Jahnke | 239/417.3 |
| 1,767,462 | 6/1930 | Lammert et al. | 239/417.3 |
| 3,468,043 | 9/1969 | Turner | 239/117 |
| 3,515,354 | 6/1970 | Presson | 239/582 |

*Primary Examiner*—M. H. Wood, Jr.
*Assistant Examiner*—Gene A. Church
*Attorney, Agent, or Firm*—Richards, Shefts & Pinckney

[57] ABSTRACT

An atomizer having a nozzle at the forward end of a body portion that has a liquid flow chamber in which a cleaning rod is disposed for reciprocation from the chamber into the nozzle, with the cleaning rod having a movable valve component formed thereon for cooperation with a stationary valve component in the body portion to control liquid flow through the atomizer in relation to the position of the cleaning rod. The movable valve component includes a tapered portion that is selectively disposed by an adjustable stop for the cleaning rod in relation to the stationary valve components to provide a selected flow rate when the valve components are in valve open position. The cleaning rod also has thereon an enlarged sealing component that is engageable with a stationary sealing component at the forward end of the chamber to seal the chamber at the nozzle when the valve components are in valve closed position.

5 Claims, 4 Drawing Figures

ATOMIZER

CROSS-REFERENCE TO RELATED APPLICATION

This is a division of U.S. Pat. application Ser. No. 432,746, filed Jan. 11, 1974, now U.S. Pat. No. 3,910,496.

BACKGROUND OF THE INVENTION

The present invention relates to atomizers of the type in which air flow is used to aspirate and atomize liquid for the control of humidity in a confined space, such as in a textile mill, and is particularly directed to atomizers of this type that are self-cleaning by the relative movement of a cleaning rod in the nozzle of the atomizer.

A typical example of the prior art in this field is my U.S. Pat. No. 3,332,623, which discloses an atomizer having a stationary cleaning rod and a nozzle formed in a carriage that reciprocates to effect relative cleaning movement of the rod in the nozzle, with the rod being in the nozzle during operation of the atomizer and with the liquid flow being controlled indirectly by controlling the characteristics of the aspirating air without positive sealing of liquid at the nozzle when the atomizer is inoperative. Examples of prior art atomizers that function similarly but have stationary nozzles and reciprocating cleaning rods are disclosed in Hodge U.S. Pat. No. 2,179,184, Simon U.S. Pat. No. 2,362,102, and Simon U.S. Pat. No. 2,186,214. Thus, direct control of the flow of liquid through an atomizer is not disclosed in the prior art, and needle valves for controlling liquid flow as disclosed in Paasche U.S. Pat. No. 2,843,425, Bramsen U.S. Pat. No. 1,960,724, Purnell U.S. Pat. No. 3,667,682, Ott U.S. Pat. No. 3,561,680, and Watanabe U.S. Pat. No. 3,195,819 are generally non-analogous in application, being directed to fuel, paint, chemical, or the like spray devices that are not adopted for nor require use with cleaning rods.

In contrast, the atomizer of the present invention combines the advantages of a cleaning rod with valve means associated with the cleaning rod for directly and finely controlling the flow of liquid to the nozzle of the atomizer while also providing positive sealing of the nozzle when the atomizer is inoperative.

SUMMARY OF THE INVENTION

Briefly described, the atomizer of the present invention has a body portion with a liquid discharge nozzle at its front end and a liquid flow chamber connected to the nozzle. A cleaning rod is reciprocably disposed in the liquid flow chamber in alignment with the liquid discharge nozzle and has formed valve component that combines with a at a rearward spacing from its forward end a movable valve component that combines with a stationary valve component disposed in the body portion to form a valve means for controlling the flow of liquid to the nozzle. Means is provided for reciprocating the rod and selectively retaining it in a rearward operative position wherein its forward end is spaced from the nozzle and the valve components are disposed in spaced open valve position and a forward inoperative position wherein its forward end is disposed within the nozzle and the valve components are in valve closing engagement. Further, there are included means for supplying liquid to the liquid flow chamber through the valve means and means for discharging air under pressure from the body portion at the nozzle to aspirate liquid from the flow chamber and atomize the liquid as it leaves the nozzle. Preferably, the rearward spacing of the movable valve component is less than the distance from the nozzle to the stationary valve component whereby the valve means is substantially closed before the forward end of the rod enters the nozzle so that liquid will be substantially cleared from the chamber before the rod enters the nozzle and dripping upon subsequent start-up is prevented, and the movable valve component extends axially sufficiently to maintain the valve means closed during cleaning movement of the rod in the nozzle. As further precautions against dripping, a slight clearance is provided in the valve means greater than the clearance between the nozzle and cleaning rod so that the liquid can back up through the valve means rather than through the nozzle, and an enlarged sealing component may be carried on the rod intermediate its forward end and the movable valve component, with this sealing component sealingly disposed at the inner end of the nozzle when the rod is in its forward inoperative position.

In the preferred embodiment the movable valve component includes a forwardly tapered frustoconical portion on the rod between a rearwardly enlarged valve closing portion and its forward end, with adjustable stop means limiting rearward movement of the cleaning rod to dispose the tapered portion selectively in the stationary valve component to control the flow of liquid through the valve means. The rod is normally yieldably retained in its forward inoperative, valve closing, position with means being included for supplying air under pressure to the body portion for application to the rod at its rearward end to move the rod to its rearward operative position against the stop means. To assure control of liquid flow by the valve means, the area of the valve opening is less than the area of the nozzle.

In another embodiment of the present invention the atomizer has a body portion with a liquid discharge nozzle at its front end and a liquid discharge chamber connected to the nozzle. Means is provided for supplying liquid to the liquid flow chamber and for controlling the liquid flow thereto, and means is provided for discharging air under pressure from the body portion at the nozzle to aspirate and atomize liquid from the nozzle. Liquid flow through the nozzle is selectively allowed and stopped by sealing means that includes a stationary sealing component at the inner end of the nozzle, with retaining means extending between the stationary sealing component and the end of the liquid flow chamber opposite the inner end of the nozzle to retain the stationary sealing component in operative position. Preferably, the liquid supplying and controlling means includes a stationary valve component at the end of the liquid discharge chamber opposite the inner end of the nozzle, and the retaining means, which is preferably resilient, extends between the stationary sealing component and the stationary valve component to retain both in operative position.

DESCRIPTION OF THE PREFERRED EMBODIMENT

Figures 1, 2, 3, 4:
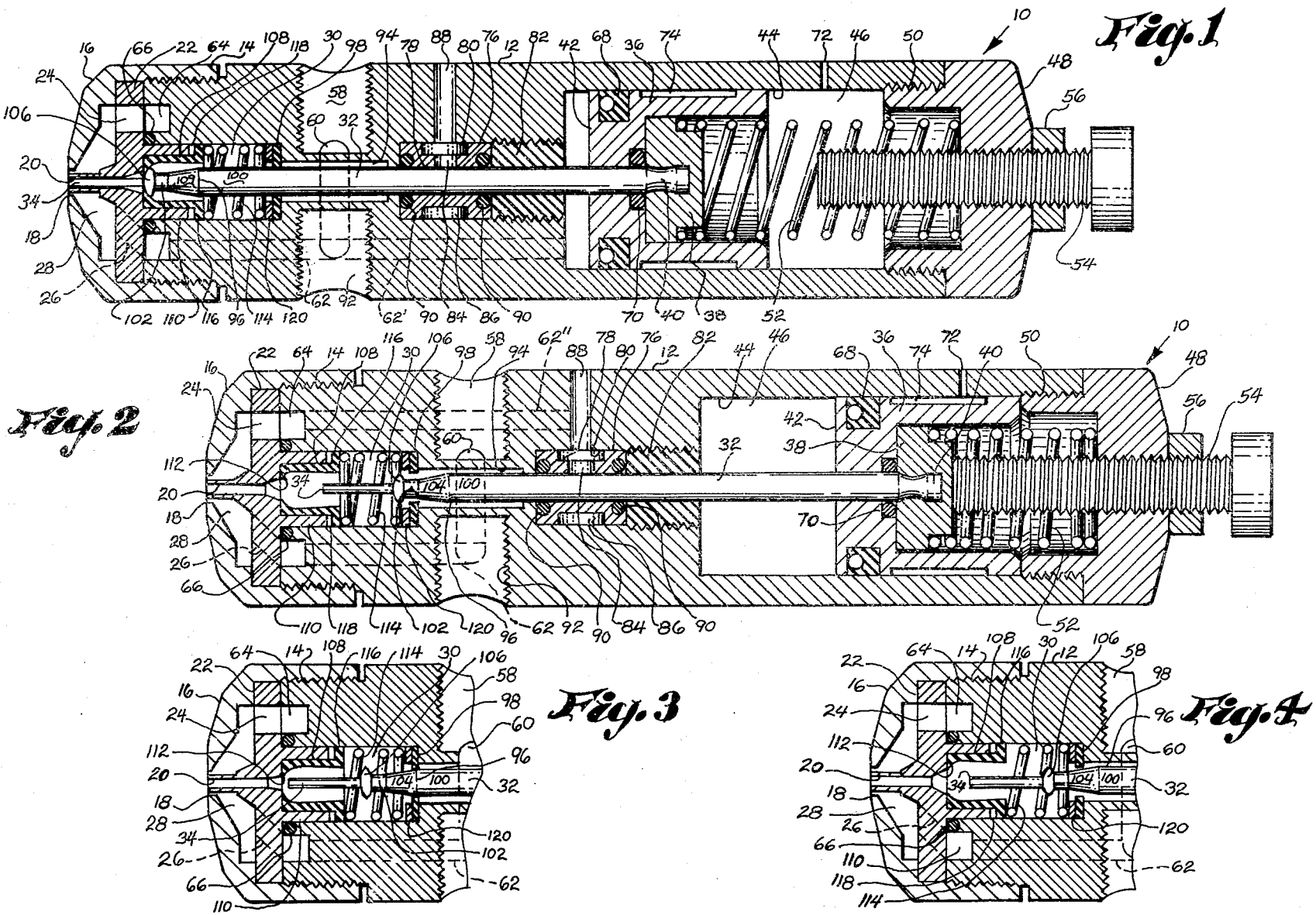
FIG. 1 is a vertical section taken axially along the length of an atomizer according to the preferred embodiment of the present invention, illustrating the cleaning rod in its forward inoperative, valve closed, position.
FIG. 2 is a vertical section similar to FIG. 1, illustrating the cleaning rod in its rearmost operative, valve fully opened, position, and illustrating a variation of the means for supplying air to move the rod.
FIG. 3 is a sectional view of the front portion of the atomizer as illustrated in FIG. 1, illustrating the cleaning rod in an intermediate valve closed position through which it moves between its operative and inoperative positions.
FIG. 4 is a view similar to FIG. 3, illustrating the cleaning rod in an adjusted operative, valve partially opened, position.

Referring to the drawings, the atomizer 10 of the preferred embodiment of the present invention has a cylindrical body portion 12 to the front end of which is threaded, as at 14, an end cap 16 that has a central aspirating orifice 18 in which the outer end of a nozzle 20 is disposed as an extension of a nozzle plate 22 that is retained between the front end of the body portion 12 and the end cap 16. The nozzle plate 22 has air apertures 24, 26 that allow air to pass forwardly therethrough from within the atomizer into a space 28 that communicates with the end cap orifice 18 to direct air past the nozzle 20 for aspiration and atomization of liquid being discharged from the nozzle 20. The air apertures may extend longitudinally, as does the aperture 24, or they may extend obliquely, as does the aperture 26, to provide a swirling action to the aspirating air, such variation allowing corresponding variation of the pattern of aspirating discharge from the atomizer 10.

Liquid, such as water in the case of the use of the atomizer 10 for humidity control, is fed to the nozzle 20 through a liquid flow chamber 30 that is of larger cross-sectional area and substantially greaater volume than the nozzle 20 to provide a continuing supply of liquid for aspiration through the nozzle 20. Disposed in this liquid flow chamber 30 for axial reciprocal movement therein is a cylindrically shaped cleaning rod 32 that has a forward end or tip 34 disposed fully in the nozzle 20 when the atomizer is in its inoperative position (FIG. 1) and which reciprocates to dispose the tip 34 rearwardly out of the nozzle 20 during atomizer operation (FIGS. 2 and 4) and return therein in a nozzle cleaning stroke at the end of atomizer operation. Reciprocation of the cleaning rod 32 is accomplished by the action of a composite piston 36 that has an inner component 38 in which the rear end 40 of the cleaning rod 32 is swaged for slight adjustable pivotal movement therein and an outer component 42 through which the cleaning rod 32 extends and that is rearwardly cup-shaped to receive the inner component 38, with the outer component 42 being slightly oversized with respect to the cleaning rod 32 and inner component 38 to allow accommodation of and cleaning rod misalignment that could bind the rod against movement during intended reciprocation. The outer component 42 extends into engagement with the wall 44 of a cylindrical piston chamber 46 formed in the rear of the body portion 12 and closed by a rear end cap 48 that is secured by threads 50 in the piston chamber 46. The piston 36 is biased forwardly to position the cleaning rod tip 34 fully in the nozzle 20 by a compression spring 52 that has one end seated against the rear end cap 48 and its other end seated against the inner component 38 of the piston 36. This compression spring 52 is yieldable against the action of air pressure in the piston chamber 46 forwardly of the piston 36 upon actuation of the atomizer 10 to force the piston 36 rearwardly, withdrawing the cleaning rod 34 from the nozzle 20 and moving it rearwardly until the inner piston component 38 abuts a stop screw 54 that is adjustably secured axially in the rear end cap 48 and is fixed in an adjusted position by a lock nut 56 disposed on the screw 54 against the outer surface of the end cap 48.

Air under pressure is introduced to the atomizer 10 for operation thereof through a radially extending port 58 formed in the top of the atomizer rearwardly of the liquid flow chamber 30. The pressurized air is fed through a conventional conduit attached by a conventional adapter (not shown) in the threaded air port 58. A lateral air passage 60 leads obliquely from the air port 58 to a longitudinal air passage 62 that extends forwardly as a first air conducting passage into communication with an annular air chamber 64 formed at the front end of the body portion 12 for communication with the aforementioned air apertures 24, 26 in the nozzle plate 22, with an O-ring seal 66 mounted at the inner edge of the annular air chamber 64 between the body portion 12 and nozzle plate 22 to prevent air flow into the liquid flow chamber 30 and to prevent liquid flow into the annular air chamber 64. The air port 58, passages 60, 62, air chamber 64, apertures 24, 26, air space 28 and aspirating orifice 18 constitute means for discharging air under pressure to aspirate liquid from the flow chamber 30 and to atomize the liquid as it leaves the nozzle 20.

The aforementioned longitudinal air passage 62 also extends rearwardly as a second air conducting passage 62' with its rearward end opening into the aforementioned piston chamber 46 at the forward end thereof to serve as means for supplying air under pressure against the outer piston component 42 for movement of the cleaning rod 32 against the biasing of the compression spring 52. As the air discharging means for aspirating action and the air supplying means for manipulating the piston are connected through the common air port 58 and air passages 60, 62, they both receive air under pressure simultaneously from a common source.

In the variation of air supplying means shown in FIG. 2 the rearwardly extending second air conducting passage 62' is omitted and air is supplied to the piston chamber 46 to move the piston through a secondary longitudinal passage 62'' having its forward end connected to the air chamber 64 so that it is, therefore, adjacent the aspirating nozzle 20, and its rearward end opening into the piston chamber. With this arrangement the air chamber 64 is intermediate the air supply and the piston chamber, assuring aspirating pressure levels in the air chamber 64 before sufficient pressure is applied to the piston 36 to move the cleaning rod 32 to an open position.

Leakage of air past the piston 36 is resisted by an annular resilient sealing ring 68 mounted in the outer piston component 42 at the piston chamber wall 44 and by an O-ring 70 mounted on the cleaning rod 32 at the juncture of the outer and inner piston components 42, 36, respectively. Furthermore, any leakage of air past the piston 36 is vented to prevent equalizing of pressure against the rear end of the piston 36 by a small bleed port 72 at the rear of the piston chamber 46 and opening to the atmosphere through the body portion 12, the bleed port 72 also being aligned with an annular recess 74 formed in the piston 36 when the piston is in its rearward position during air pressurization of the atomizer.

Leakage of air from the piston chamber 46 forwardly into the liquid flow chamber 30 and flow of liquid rearwardly from the liquid flow chamber 30 into the piston chamber 46 is prevented by a bleeding assembly 76 disposed centrally in the body portion 12 between the two chambers. This bleeding assembly 76 includes a cylindrical sleeve 78 mounted axially on the cleaning rod 32 in an enlarged bore 80 in the body portion 12 and retained therein by a bearing block 82 that is threaded in the bore 80 adjacent the piston chamber 46 for support and guidance of the cleaning rod 32 during reciprocation thereof. This sleeve 78 has a radial aperture 84 opening onto the surface of the cleaning rod 32 and communicating with an outer annular recess 86 that in turn communicates with a radial port 88 opening in the body portion 12 to the atmosphere. A pair of O-rings 90 are mounted on the cleaning rod 32 at opposite ends of the sleeve 78 to resist passage of liquid rearwardly and passage of air forwardly, with the bleeding assembly allowing escape of air or liquid and to neutralize any pressure from either the liquid supply or the air supply.

Liquid, such as water, is supplied to the atomizer 10 through a liquid port 92 diametrically opposed to the air port 58 and being similarly threaded for connection of a conventional conduit through which liquid is delivered from a supply. This liquid port 92 opens into a reduced bore 94 formed centrally in the body portion 12 and surrounding at a substantial clearance the cleaning rod 32 so that liquid can flow freely from the liquid port 92 into the liquid flow chamber 30. Disposed between the reduced bore 94 and the liquid flow chamber 30 is valve means that includes a movable valve component 96 formed on the cleaning rod 32 and a stationary valve component 98 in the form of a resilient annularly shaped disc seated against the inner end of the liquid flow chamber 30 and surrounding the cleaning rod 32.

The movable valve component 96 includes a rearward enlarged cylindrical portion 100, a forward reduced cylindrical portion 102 and an intermediate forwardly tapered frustoconical portion 104 disposed between and connecting the enlarged cylindrical portion 100 and reduced cylindrical portion 102. These valve portions are located with respect to the stationary valve component 98 so that when the cleaning rod 32 is fully forward the enlarged cylindrical portion 100 will be aligned with the stationary valve component 98 to substantially close the valve means against flow of liquid from the liquid port 92 into the liquid flow chamber 30 and when the cleaning rod 32 is in a rearward position as determined by the stop screw 54 either the reduced cylindrical portion 102 or the tapered portion 104 will be aligned with the stationary valve component 98 to provide a selective opening of the valve means to provide controlled flow of liquid into the liquid flow chamber 30 and through the nozzle 20. To assure control of flow by the valve means, the area of opening at the valve means is less than, preferably between about ½ and ⅓, the area of opening of the nozzle 20, and the tip 34 of the cleaning rod 32 is always disposed out of the nozzle 20 when the valve means is open, which condition is assured by locating the cleaning rod tip 34 at a spacing from the enlarged cylindrical portion 100 of the valve means less than the spacing between the stationary valve component 98 and the nozzle 20. In this way, the cleaning rod tip 34 does not restrict liquid flow through the nozzle 20 and it can be formed at an outer diameter closely identical to the inner diameter of the nozzle 20 for effective cleaning thererof, which is not possible with prior art atomizers that require location of the cleaning rod in the nozzle during operation.

The flow control obtained by the valve means is not dependent on the aspirating air pressure and flow and is finely adjustable due to the relatively gradual taper on the tapered portion 104, which allows a substantial range of adjustment of the stop screw 54 to dispose the tapered portion 104 at a selected position with respect to the stationary valve component 98 for desired liquid flow. Thus, longer periods of operation at lesser flow rates can be utilized to obtain more even atomizing conditions in the space in which the atomizer 10 is being used, and large or small flow rates can be readily provided to suit conditions in the space in which the atomizer is being used.

The aforementioned enlarged movable valve component portion 100 extends longitudinally sufficiently to provide a valve closed condition from prior to entry of the cleaning rod 32 into the nozzle 20 through the completion of the cleaning stroke of the nozzle and until the rod is subsequently retracted from the nozzle on the next actuation of the atomizer 10. Also, a slight clearance is provided between the enlarged portion 100 of the movable valve component 96 and the stationary valve component 98 to allow backflow of liquid from the liquid flow chamber 30 when the cleaning rod 32 advances to its forward position and thereby occupies greater space in the liquid flow chamber 30, reducing the space available to contain the liquid. In this connection, the clearance between the cleaning rod tip 34 and the nozzle 20 is preferably less than aforementioned clearance in the valve means so that as the cleaning rod moves forward the liquid will be displaced as backflow through the valve means rather than as leakage or dripping through the nozzle 20. Moreover, the tension in the aforementioned compression spring 52 is related to normal operating air pressure so that when the atomizer is being closed down the force of the spring will move the cleaning rod 20 forward to close the valve means before the air pressure has reduced below that capable of aspirating and atomizing air from the liquid flow chamber 30 with the result that liquid will continue to be aspirated from the chamber after initial closing of the valve means, thereby reducing the possibility of sufficient liquid being in the chamber to cause dripping. For this purpose the compressioin of the spring 52 is preferably such that cleaning rod movement does not occur and the valve means remains substantially closed until the air pressure exceeds between about ½ and ¾ the normal operating air pressure for the atomizer. This pressure relationship also prevents dripping or spewing upon start-up of the atomizer as the spring maintains the cleaning rod 32 in its forward closed position until sufficient air pressure is developed to produce aspiration when the cleaning rod 32 reciprocates to open the valve means after the delay imposed by the spring 52.

Because of the aforementioned clearance in the valve means when closed, it is possible that liquid could without some sealing means flow from the supply into the liquid flow chamber 30 and drip through the nozzle when the atomizer is inoperative. To prevent this, positive sealing means is provided at the inner end of the nozzle 20 in the form of a movable sealing component formed as an enlarged annular shoulder 106 on the cleaning rod 32 at the juncture of the inner end of the cleaning rod tip 34 and the movable valve component 96. The sealing means also includes a stationary component in the form of a cup-shaped insert 108 seated at the inner end of the nozzle 20 in an inwardly extending cylindrical flange 110 on the nozzle plate 22. This stationary sealing means insert 108 has a central orifice 112 aligned with nozzle 20 and is formed of long-wearing material, such as Teflon, for impact-resistant seating of the movable sealing component 106 therein to seal the nozzle 20 when the aforementioned compression spring 52 biases the cleaning rod 32 in its forward valve closed inoperative position, the force of the spring being sufficient to press the movable sealing component 106 against the stationary sealing component 108 to effect a positive liquid seal.

The length of the cleaning rod tip 34 beyond the movable sealing component 106 is substantially equal to the length of the nozzle 20 so that the cleaning rod tip 34 will extend completely through the nozzle 20 when the cleaning rod is in its forward sealing position, thereby assuring cleaning of the entire interior surface of the nozzle 20 during each nozzle-closing stroke of the cleaning rod 32.

As the stationary sealing component insert 108 is a separate element, it can be removed and replaced readily, and it is retained in assembled position by resilient retaining means in the form of a compression spring 114 that has one end positioned against a radially outward projecting rim 116 on the movable sealing insert 108 that overlays the aforementioned nozzle plate flange 110 with an annular washer 118 therebetween. The other end of the compression spring 114 is located at the inner end of the liquid flow chamber 30 against an annular washer 120 that is seated at the front side of the aforementioned stationary valve component disc 98. Thus the compression spring 114 serves to retain both the stationary sealing component insert 108 and the stationary valve component disc 98 in assembled position, and the pressure of the compression spring 114 against the sealing means insert 108 also provides, by transmission through the nozzle plate 22 to the front end cap 116, a tightening pressure on the threads 14 that connect the end cap 16 to the body portion 12, thereby maintaining the end cap 16 tightly on the body portion against unintentional loosening or separation of the parts.

To use the atomizer 10, it is first mounted in a suitable location and connected to a source of liquid and air under pressure with the elements in initial inoperative positions, as shown in FIG. 1, the cleaning rod 32 being biased by the compression spring 52 to its forwardmost position with the cleaning rod tip 34 in the nozzle 20, the movable sealing component 106 being seated against the stationary sealing component insert 108 to seal the liquid flow chamber 30, and the enlarged movable valve component portion 100 being disposed at the stationary valve component 98 in closed valve means condition.

When the atomizer 10 is to be actuated, air under pressure is supplied through the air port 58 and is divided by the longitudinal air passage 62 with a portion going to the air cap orifice 18 for aspiration and atomization of liquid from the nozzle 20 when the cleaning rod moves rearwardly and the remaining portion of the air being directed by the longitudinal air passage 62 to the piston chamber 46 to build up pressure for rearward movement of the piston 36. When the air pressure has increased sufficiently to overcome the compression of the spring 52, the piston 36 moves rearwardly, thereby moving the cleaning rod 32 axially rearward, during which movement the cleaning rod tip 34 moves out of the nozzle 20 and allows any liquid in the liquid flow chamber 30 to be aspirated out of the nozzle 20 while the valve means remains initially closed by the extended length enlarged movable valve portion 100 being in the stationary valve component 98. This location of the elements is illustrated in FIG. 3. Upon further movement of the cleaning rod 32 rearwardly the tapering portion 104 of the movable valve component 96 will be disposed in alignment with the stationary valve component 98 to progressively open the valve means and allow liquid to flow into the chamber 30 and be aspirated from the nozzle 20. This location of the elements is illustrated in FIG. 4. The location of the tapering portion 104 with respect to the stationary valve component 98 determines the rate of liquid flow and this positioning is determined by the adjustable position of the stop screw 54, which may be retracted sufficiently to allow the cleaning rod 32 to be fully retracted for fully open valve positioning of the reduced movable valve component portion 102 at the stationary valve component 98. This is illustrated in FIG. 2. During the period of operation the elements remain in the position determined by the setting of the screw 54, and upon deactuation of the atomizer by closing of the air supply, the air pressure will first drop to a level that allows the compression spring 52 to overcome the air pressure and thereby move the cleaning rod 32 forwardly, first closing the valve means (FIG. 3) and then sealing the nozzle 20 (FIG. 1).

With the above-described preferred embodiment of the atomizer of the present invention, direct control over liquid flow is obtained in a positive selective manner while providing effective nozzle cleaning by reciprocation of the cleaning rod 32 in the nozzle 20, with the cleaning rod 32 being completely withdrawn from the nozzle 20 during atomizer operation, which eliminates any provision for liquid flow clearance of the rod in the nozzle and reduces substantially the fluid friction and resultant aspirating air pressure requirements in comparison with prior atomizers in which the cleaning rod is located in the nozzle during operation. Moreover, the reciprocation of the cleaning rod rather than reciprocation of a nozzle carriage of prior atomizers results in less material mass to be moved and thus also requires less air pressure to actuate the atomizer into its operative position and allows faster action, less wear, and lighter stroke-end impact. Furthermore, dripping or spewing of liquid from the atomizer is substantially eliminated by the closing of the valve means before the air pressure reduces below that necessary to aspirate liquid from the chamber and by the sealing means positively sealing the nozzle without opening subsequently until aspirating air pressure is developed as a following operation is begun. This latter advantage allows the use of a pressure system for supplying liquid rather than only a gravity system as is used in common prior atomizers.

With the aforementioned relationship of the area of the valve means opening being less than the area of the nozzle to assure control of liquid flow by the valve means without limitation by the nozzle, a further advantage is obtained in combination with the liquid flow chamber 30 being substantially larger in volume than the nozzle 20, as this provides a space in which the liquid will be preliminarily broken-up in the chamber by the aspirating effect rather than the liquid flowing in a full stream through the chamber, thereby enhancing the atomizing effectiveness of the device.

It is to be understood that various modifications and alterations may be made within the scope of the present invention and that it is not to be limited to the preferred embodiment described and illustrated in detail herein, except as defined in the appended claims.

I claim:

1. An atomizer comprising a body portion having a liquid discharge nozzle at the front end thereof and a liquid flow chamber connected to said nozzle, means for supplying liquid to said liquid flow chamber and for controlling the liquid flow thereto, means for discharging air under pressure from said body portion at said nozzle to aspirate and atomize liquid from said nozzle, sealing means selectively operable for allowing and stopping liquid flow through said nozzle, said sealing means including a stationary sealing component at the inner end of said nozzle, and retaining means extending between said stationary sealing component and the end of said liquid flow chamber opposite said inner end of said nozzle to retain said stationary sealing component in operative position.

2. An atomizer as defined in claim 1 and further characterized in that said retaining means is resilient.

3. An atomizer as defined in claim 2 and further characterized in that said nozzle is disposed in a removable nozzle plate at the end of said liquid discharge chamber, and by a cap threadably mounted on said body portion and providing an atomizing orifice at the outer end of said nozzle, said cap retaining said nozzle plate in position and said resilient retaining means acting through said nozzle plate and cap to tighten the threaded connection of said cap on said body portion.

4. An atomizer as defined in claim 1 and further characterized in that said supplying and controlling means includes a staionary valve component at said end of said liquid flow chamber opposite said inner end of said nozzle, said retaining means extending between said stationary sealing component and said stationary valve component to retain both in operative position.

5. An atomizer as defined in claim 4 and further characterized in that said retaining means is a compression spring biasing said stationary sealing component forwardly and said stationary valve component rearwardly.

* * * * *

UNITED STATES PATENT OFFICE
CERTIFICATE OF CORRECTION

Patent No. 3,977,609 Dated August 31, 1976

Inventor(s) Donald A. Gallant

It is certified that error appears in the above-identified patent and that said Letters Patent are hereby corrected as shown below:

Column 1, line 54, after "formed" delete "valve component that combines with a" and insert therefor --thereon--; Column 3, line 38, delete "greaater" and insert therefor --greater--; and Column 6, line 52, delete "compressioin" and insert therefor --compression--.

Signed and Sealed this

Seventh Day of December 1976

[SEAL]

*Attest:*

RUTH C. MASON
*Attesting Officer*

C. MARSHALL DANN
*Commissioner of Patents and Trademarks*